US005347805A

United States Patent [19]

Butzke et al.

[11] Patent Number: 5,347,805

[45] Date of Patent: Sep. 20, 1994

[54] TWO-FOR-ONE-TWISTING SPINDLE WITH A COMPRESSED AIR OPERATED THREADING DEVICE

[75] Inventors: Frank Butzke, Tönisvorst; Heinz Fink, Krefeld; Wolfgang Leupers, Mönchengladbach, all of Fed. Rep. of Germany

[73] Assignee: Palitex Project-Company GmbH, Krefeld, Fed. Rep. of Germany

[21] Appl. No.: 802,067

[22] Filed: Nov. 26, 1991

[30] Foreign Application Priority Data

Nov. 29, 1990 [DE] Fed. Rep. of Germany ..... 4037951

[51] Int. Cl.[5] ..... D01H 15/007

[52] U.S. Cl. ..... 57/279

[58] Field of Search ..... 57/279, 58.7, 58.83, 57/58.84

[56] References Cited

U.S. PATENT DOCUMENTS

| | | | |
|---|---|---|---|
| 4,168,605 | 9/1979 | D'Agnolo | 57/279 |
| 4,338,774 | 7/1982 | Welters | 57/279 X |
| 4,453,377 | 6/1984 | Inger et al. | 57/279 |
| 4,542,618 | 9/1985 | Lossa | 57/58.83 |

FOREIGN PATENT DOCUMENTS

| | | | |
|---|---|---|---|
| 0026159 | 4/1981 | European Pat. Off. . | |
| 2936649 | 4/1981 | Fed. Rep. of Germany | 57/279 |

*Primary Examiner*—Joseph J. Hail, III

*Attorney, Agent, or Firm*—Robert W. Becker & Associates

[57] ABSTRACT

A two-for-one twisting spindle with a compressed air operated threading device is provided. The thread is feed via a jet of compressed air through a thread feeding channel of a thread storage disk. At the outer opening of the thread feeding channel a first deflecting surface is provided which is attached to the underside of the turntable. The first deflecting surface is provided with a upwardly curved second deflecting surface which is essentially convex. These constructive measures at the outer opening of the thread feeding channel ensure that the jet of compressed air exiting from the outer opening of the thread feeding channel has a certain vertical width h and that the radius of curvature R of the second deflecting surface is such that the ratio of the radius of curvature to the width h corresponds to $R/h \geqq 3$. This ensures that the jet of compressed air is deflected in an upward direction essentially vertically with the aid of the so-called Coanda effect.

10 Claims, 5 Drawing Sheets

TWO-FOR-ONE-TWISTING SPINDLE WITH A COMPRESSED AIR OPERATED THREADING DEVICE

BACKGROUND OF THE INVENTION

The present invention relates to a two-for-one twisting spindle with a compressed air operated threading device with which a thread is fed through a thread feeding channel by a jet of compressed air, with a first deflecting surface arranged at an underside of a turntable, disposed above a thread storage disk, and extending radially outwardly from an opening of a radial portion of the thread feeding channel whereby the first deflecting surface has a transition into a second deflecting surface that extends in an upward direction and is convex.

Such a two-for-one twisting spindle is known from EP 00 26 159 B1. With this known device, the jet of compressed air which leaves the thread feeding channel and carries the end of the thread with it is guided against a deflector plate. This deflector is fixedly or adjustably arranged relative to the turntable of the spindle at a position between the outer curved opening of the thread feeding channel and the outer edge of the turntable. The deflector plate is embodied such that its upper end extends at least to the height of the center axis of the outer opening of the thread feeding channel and the extension of its front end surface is essentially tangential to a second deflecting surface which is upwardly curved and convex.

In the above cited publication it is mentioned that the aforementioned device presumably relies on the so-called Coanda effect according to which a jet of air which is guided along a convex curved surface is deflected such that it follows the curvature of the surface.

With the known device, however, the deflection of the air jet is essentially effected by the deflector plate.

The known device has the disadvantage that the deflector plate must be arranged over the entire circumference of the turntable, or an exact position of the outer opening of the thread feeding channel relative to the deflector plate during the threading step, or an adjustment of the deflector relative to the outer opening must be provided in order to be able to perform the threading step. This requires complicated measures and disadvantageous especially for automatic threading.

A further disadvantage of the known device is the soiling and contamination of the surface of the fixedly connected deflector which is not contacted by the thread during the twisting process. Due to fluctuations of the position of the thread balloon, portions of the thread may come into contact with the contaminated surfaces which will result in a reduced quality of the resulting twisted thread.

Another possibility of deflecting a thread without a fixedly arranged deflector is described in DE 29 39 593 C2. In this device a second jet of compressed air is used which deflects the jet of compressed air together with the thread essentially about an angle of 90° in an upward direction. This solution is also rather complicated and requires an exact positioning of the outer opening of the thread feeding channel relative to the second jet of compressed air during the threading step.

It is therefore an object of the present invention to provide a two- for-one twisting spindle with the aforementioned features which provides for an automatic threading of the thread without providing a deflector plate that is fixedly connected relative to the rotatable components of the spindle.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
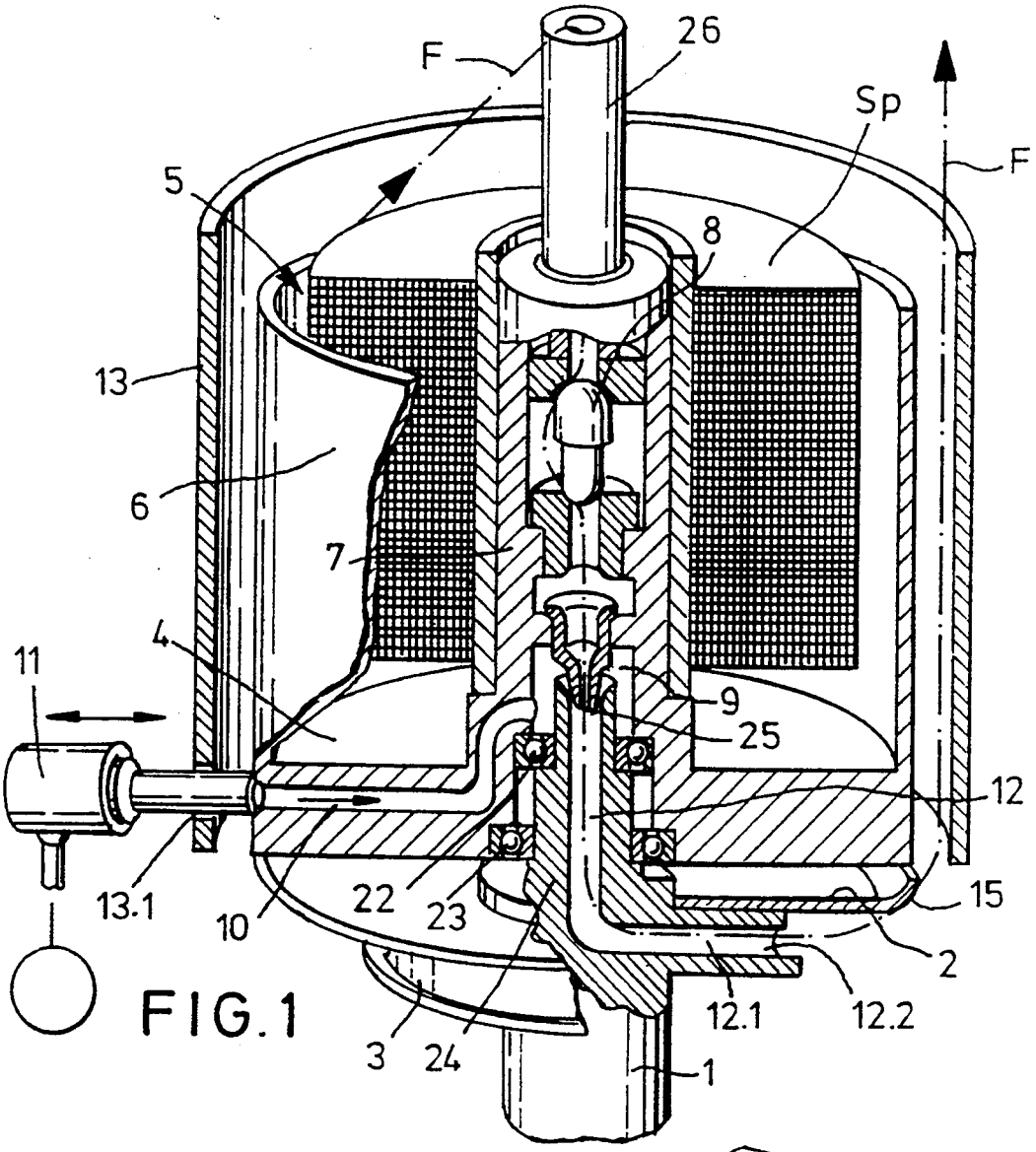
FIG. 1 is an elevated, partially cross-sectioned side view of a two-for-one twisting spindle with an automatic thread feeding device.

The two-for-one twisting spindle of the present invention is primarily characterized by the jet of compressed air leaving the opening of the thread feeding channel having a width h in a vertical direction and the second deflector having a radius of curvature R, whereby a ratio of the width and the radius of curvature is $R/h>3$. In a preferred embodiment the ratio is $3<R/h<5$. It is especially preferred that the ratio be at least approximately $R/h=4$.

It is expedient that a ratio of a first angle $\beta 1$ of upward inclination of an upper wall of the radial portion relative to a horizontal plane to a second angle $\beta 2$ of upward inclination of the first deflecting surface relative to the first horizontal plane is $\beta 1>\beta 2$. The second deflecting surface at an upper end thereof has preferably a vertical tangent. Furthermore, a third angle $\delta$ is defined between a tangential plane of the second deflecting surface at the transition between the first and the second deflecting surface and the horizontal plane. When the tangential plane is ascending relative to the horizontal plane and the third angle is $0<\delta<+90°$, the relation between the second and the third angle is $\delta<\beta 2<+90°$. When the tangential plane is descending relative to the horizontal plane and the third angle is $-90° < \delta \leqq 0$, the relation between the second and the third angle is $0 \leqq \beta 2 < +90° + \delta$.

It is preferable that the width h of the jet of compressed air is determined by a height of the opening of the radial portion of the thread feeding channel. The width of the jet of compressed air may be determined by an insert within the radial portion of the thread feeding channel which is positioned before the opening. The insert may be in the form of a wedge having an upper surface that ascends in a direction towards the opening. The upper surface, viewed in a direction of the jet of compressed air, may have a first portion that is linearly ascending and a second portion that is upwardly curved to form a concave surface. Furthermore, the horizontal width of the insert is smaller than a horizontal width of the radial portion of the thread feeding channel. The end face of the insert, viewed in a direction of the jet of compressed air, may be essentially flush with the opening of the radial portion or may be arranged at a distance from the opening of the radial portion.

In another embodiment the width of the jet of compressed air is determined by a deflector plate connected to the opening at a lower edge thereof, whereby the deflector plate extends vertically upward over at least a portion of a horizontal width and a portion of a vertical width of the radial portion of the thread feeding channel and has a sharp-edged upper end. Preferably, the vertical height of the deflector plate is from 1 mm to 2 mm.

The present invention is based on the finding that the Coanda effect at a two-for-one twisting spindle may be employed for the deflection of the thread leaving a thread feeding channel without providing fixedly connected deflectors and solely by providing measures at the spindle rotor itself. A prerequisite is that the expansion of the jet of compressed air in a vertical direction relative to the deflecting surface must be minimized.

As disclosed infra with respective embodiments the various parameters for the secure contact of the jet of compressed air at the convex curved second deflecting surface as well as textile technologically preset requirements of the rotor of a two-for-one twisting spindle must be considered. The inventive embodiment of the two-for-one twisting spindle has the advantage that no exact positioning of the spindle rotor is required during the threading step and that no deflector plates which tend to be easily contaminated are required.

DESCRIPTION OF PREFERRED EMBODIMENTS

The present invention will now be described in detail with the aid of several specific embodiments utilizing FIGS. 1 through 9.

With the aid of FIG. 1 the design of a two-for-one twisting spindle with a compressed air operated threading device will be described in detail in the following paragraphs.

The two-for-one twisting spindle comprises essentially a whorl 1, a turntable 2 with a thread storing disk 3 and a protective pot 5 into which a feed bobbin Sp is inserted. The protective pot 5 comprises a cylindrical side wall 6, a bottom portion 4 and a hollow spindle 7. The protective pot 5 is positioned on a spindle rotor 24 via respective bearings 22, 23.

The bottom 4 is provided with a radially extending channel 10. The outer port of the channel 10 is arranged opposite an opening 13.1 within the balloon limiter 13. A connector 11 which is connected to a compressed air source (not represented in the drawing ) may be inserted through the opening 13.1 in order to provide the channel 10 with compressed air.

The inner end of the channel 10 connects to a chamber 9 in which an injector nozzle 25 is provided within the inlet opening of a thread feeding channel 12 that extends through the spindle rotor 24. Above the injector nozzle 25 a thread brake 8 is provided within the hollow spindle 7 in a known manner.

When a thread F coming from the feed bobbin Sp is to be threaded the connector 11 is connected to the channel 10 so that compressed air is introduced into the chamber 9 and the injector nozzle 25 via the channel 10. The jet of compressed air generates a suction that will suck the thread F which is held at the upper end of the thread insertion pipe 26 downward and will guide the thread F after passing the thread brake 8 and the injector nozzle 25 through the thread feeding channel 12 until the thread leaves the thread feeding channel 12 via the outer opening 12.2 of the radial portion 12.1 which is arranged within the thread storage disk 3. As can be seen from FIG. 1 the jet of compressed air leaving the outer opening 12.2 of the thread feeding channel 12 should be deflected in an upward direction such that the thread F is introduced into the space between the protective pot and the balloon limiter 13 and is guided in an upward direction within this space so that the thread at the upper end of %he balloon limiter 13 may be gripped by operating personnel or an automatic device.

In the following paragraph the influence of various parameters to be considered in order to ensure a secure deflection in an upward direction after the thread leaves the thread feeding channel 12 via the outer opening 12.2 without providing a deflector plate that is fixedly arranged relative to the turntable will be discussed with the aid of FIG. 2.

The turntable 2, at its underside, is provided with a first deflecting surface 14 arranged at least in the area of the outer opening 12.2 of the thread feeding channel 12 which extends radially from the outer opening 12.2. The deflecting surface 14 has a transition into a second deflector 15 which is curved in an upward direction and is convexly shaped. The jet of compressed air should be guided along the two deflecting surfaces 14, 15 and should be deflected such that an angle $\alpha$ between the vertical plane and the thread is minimized.

Figure 2:
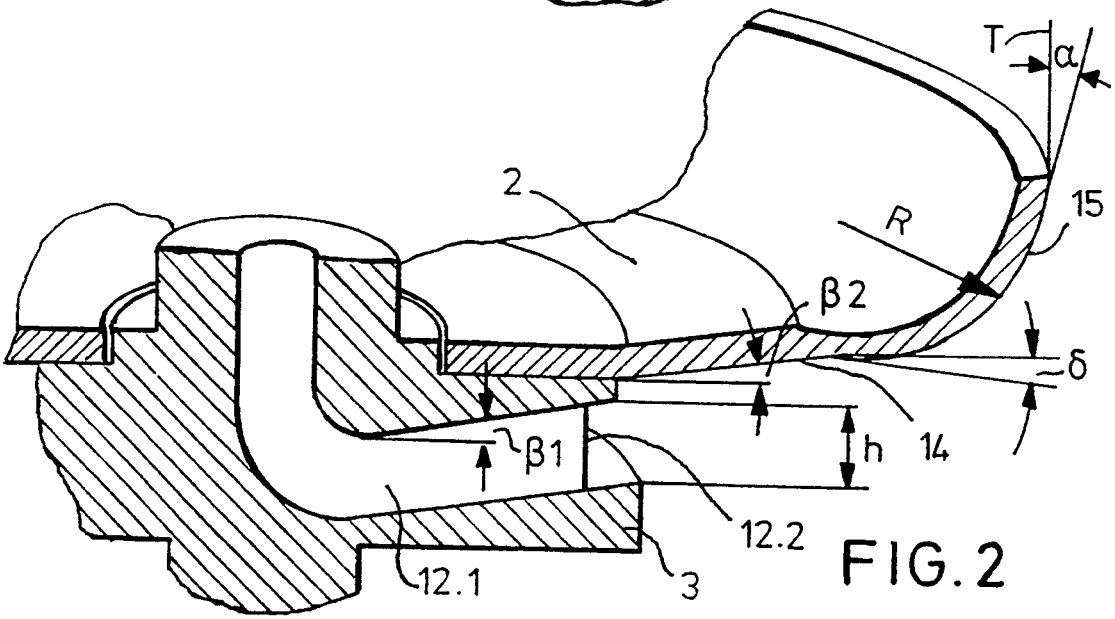
FIG. 2 is a detailed, partially elevated vertical cross-section of a portion of the turntable and the thread storage disk of the two-for-one twisting spindle in the area of the outer end of the thread feeding channel of a first embodiment of the invention.
Figure 2A:
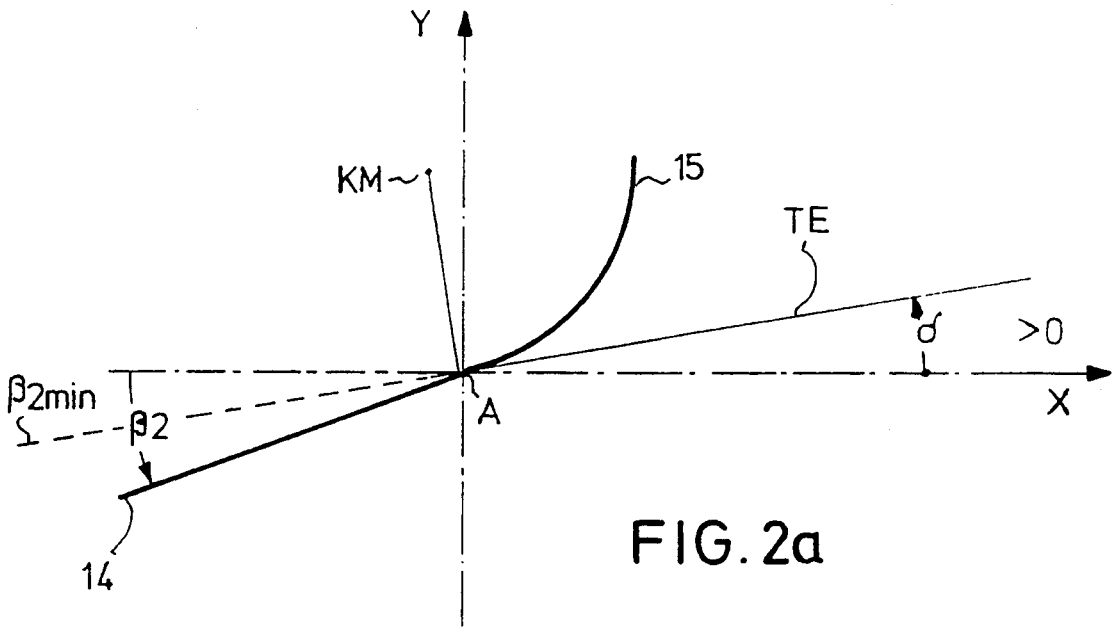
FIGS. 2*a* and 2*b* show a schematic representation of the geometric relations in the area of the transition between the first and the second deflecting surfaces of the embodiment of FIG. 2.
Figure 2B:
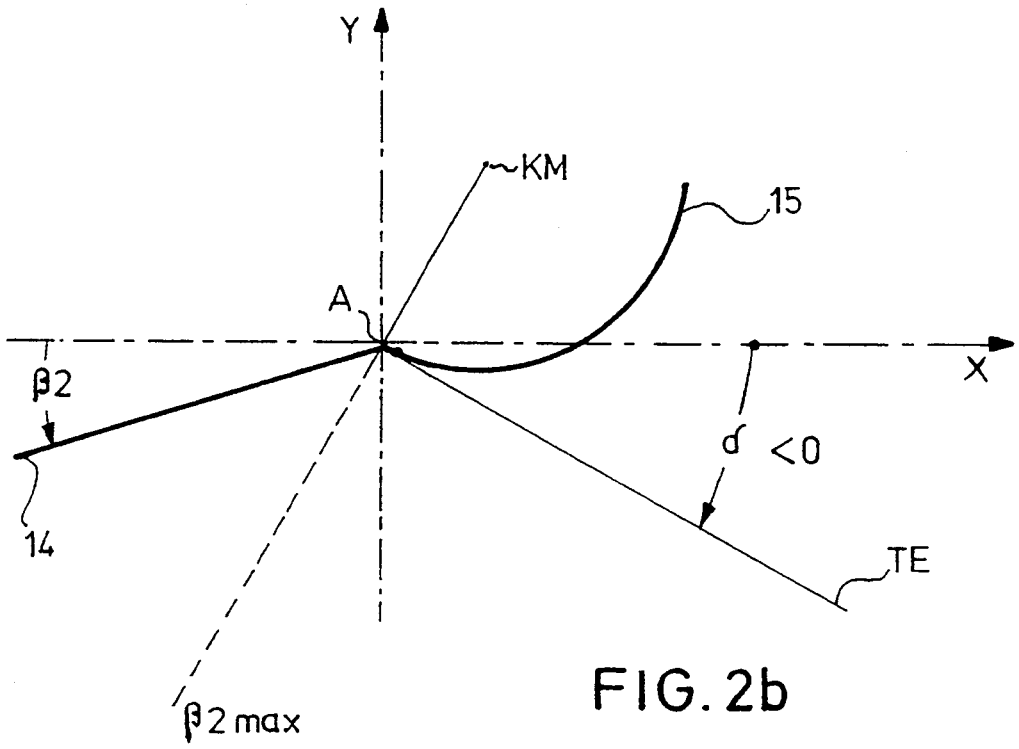

It has been demonstrated that the following parameters which can be taken from FIG. 2 are essential for such a deflection when using the Coanda effect:

- the radius of curvature R of the second deflecting surface 15;
- the width h of the jet of compressed air in the vertical direction;
- the angle $\beta 1$ of an upward inclination of the upper wall of the radial portion of the thread feeding channel at the outer opening relative to a horizontal plane; and
- the angle $\beta 2$ between the first deflecting surface and the horizontal plane.

When experimenting and selecting the right conditions for a secure deflection of the jet of compressed air it must be taken into consideration that for the classic Coanda effect surfaces are presupposed that are planar transverse to the direction of the jet of compressed air and are curved only in the direction of the jet of compressed air. However, this is not the case with two-for-one twisting spindles because the cylindrical sidewall 6 of the protective pot 5 and the turntable 2 are curved transverse to the jet of compressed air. Furthermore, the varying operational conditions at a two-for-one twisting spindle during the threading step on the one hand and the normal operation on the other hand must be considered. During the threading step the thread exits from the outer opening 12.2 of the thread feeding channel 12 and should be deflected immediately in an upward direction. During the normal operation, the thread exits the outer opening 12.2 of the thread feeding 12 channel and is wound about the circumference of the thread storage disk 3 in a single or multiple windings.

A favorable effect is observed when the radius of curvature R is selected to be as great as possible and the width h is selected to be as small as possible. Due to technological requirements the radius of curvature R may not be chosen to be indefinitely great because, on the one hand, the thread coming from the turntable 2 must have a defined point of departure before entering the thread balloon and on the other hand the height of the thread balloon must be minimized.

The width h may not be indefinitely minimized since a secure passage of the thread within the jet of compressed air through the outer opening 12.2 of the thread feeding channel 12 and an uninterrupted build-up of the thread to be stored at the circumference of the thread storage disk 3, especially when a storage angle of more than 360° must be ensured. It is thus necessary that the thread enters the respective groove at the thread storage disk at the lowest point for the first winding and that the second winding of the storage step is positioned at a sufficient distance above the first winding at the thread storage disk. A disruption of this relation may result in thread breakage.

It has been shown that good results may be obtained when the ratio of the radius of curvature R to the width h corresponds to $R/h \geqq 3$. Especially good results are obtained for a ratio $R/h \geqq 4$.

The angles $\beta 1$ and $\beta 2$ should be great in order to achieve a favorable direction of the jet of compressed air. However, the increase of the angles is adversely influenced by economic reasons which are related to the filling volume of the spindle. An increase of the angle would result in a reduction of the diameter when the height of the protective pot is maintained or an increase of the height of the protective pot 5 when the diameter of the pot 5 is maintained. This, however, should be avoided.

Favorable results are obtained when $\beta 1$ is $\geqq \beta 2$, whereby $\beta 2$ may equal 0.

The tangent T at the side of the second deflecting surface 15 where the jet of compressed air leaves should be essentially vertical.

The transition of the first deflecting surface 14 into the curved second deflecting surface 15 may be such that the first deflecting surface 14 may be superimposed by the tangential plane at the second deflecting surface 15 at the point of the transition A between the two deflecting surfaces. However, this is not a prerequisite. It has been shown that it is favorable when the first deflecting surface 14 encloses a predetermined angle with the respective tangential plane. The geometric conditions which must be observed will be discussed in the following with the aid of FIGS. *2a* and *2b*. For the description of the geometric conditions the angle $\beta 2$ of the first deflecting surface 14 as well as the angle $\delta$ between the tangential plane TE of the second deflecting surface 15 at the transition A between the first deflector 14 and the second deflector 15 relative to the horizontal plane are employed. As can be seen from the FIGS. *2a* and *2b*, the tangential plane TE may ascend or descend relative to the horizontal plane (FIG. *2a*, respectively FIG. *2b*). The FIGS. *2a* and *2b* demonstrate the relative relations with the aid of a coordinate system the origin of which lies at the transition A between the first deflecting surface 14 and the second deflecting surface 15. The X-axis of the coordinate system extends horizontally to the right and the respective Y-axis extends vertically in an upward direction. The coordinate system is indicated with dash-dotted lines. The center point of the curvature of the second deflecting surface 15 is indicated by KM. As can be seen from the figures an ascending tangential plane TE relative to the horizontal axis X within the coordinate system in the clockwise direction corresponds to a positive angle $\delta$. This means that $0<\delta<+90°$. A descending tangential plane TE corresponds to a negative angle within the coordinate system in the clockwise direction and the condition is that $-90°<\delta \leqq 0$.

When the tangential plane is ascending relative to the horizontal plane, a relation between the second and the third angle is $\delta<\beta 2<+90°$. When the tangential plane TE is descending relative to the horizontal plane, a relation between the second and the third angle is $0 \leqq \beta 2<+90°+\delta$. FIG. *2a* shows for an ascending tangential plane TE the respective angle and the smallest corresponding angle $\beta 2$ as a dash-dotted line and marked $\beta 2$ min. The angle $\beta 2$ extends in the direction of the tangential plane TE. A horizontal position of the first deflecting surface 14 is thus only possible when the tangential plane TE is also horizontally oriented.

FIG. *2b* shows the upper limit for the angle $\beta 2$ as a dash-dotted line and marked $\beta 2$ max. $\beta 2$ may not correspond to the upper limit value of $\beta 2$ max. In this case the first deflecting surface 14 would be oriented vertically to the tangential plane TE. When the tangential plane TE is descending $\beta 2$ may be 0 without $\delta$ being 0 at the same time.

For the aforementioned relations between the respective angles the jet of compressed air deflected at the first deflecting surface 14 is guided along the second deflecting surface 15 under the so-called Coanda effect.

Figure 3:
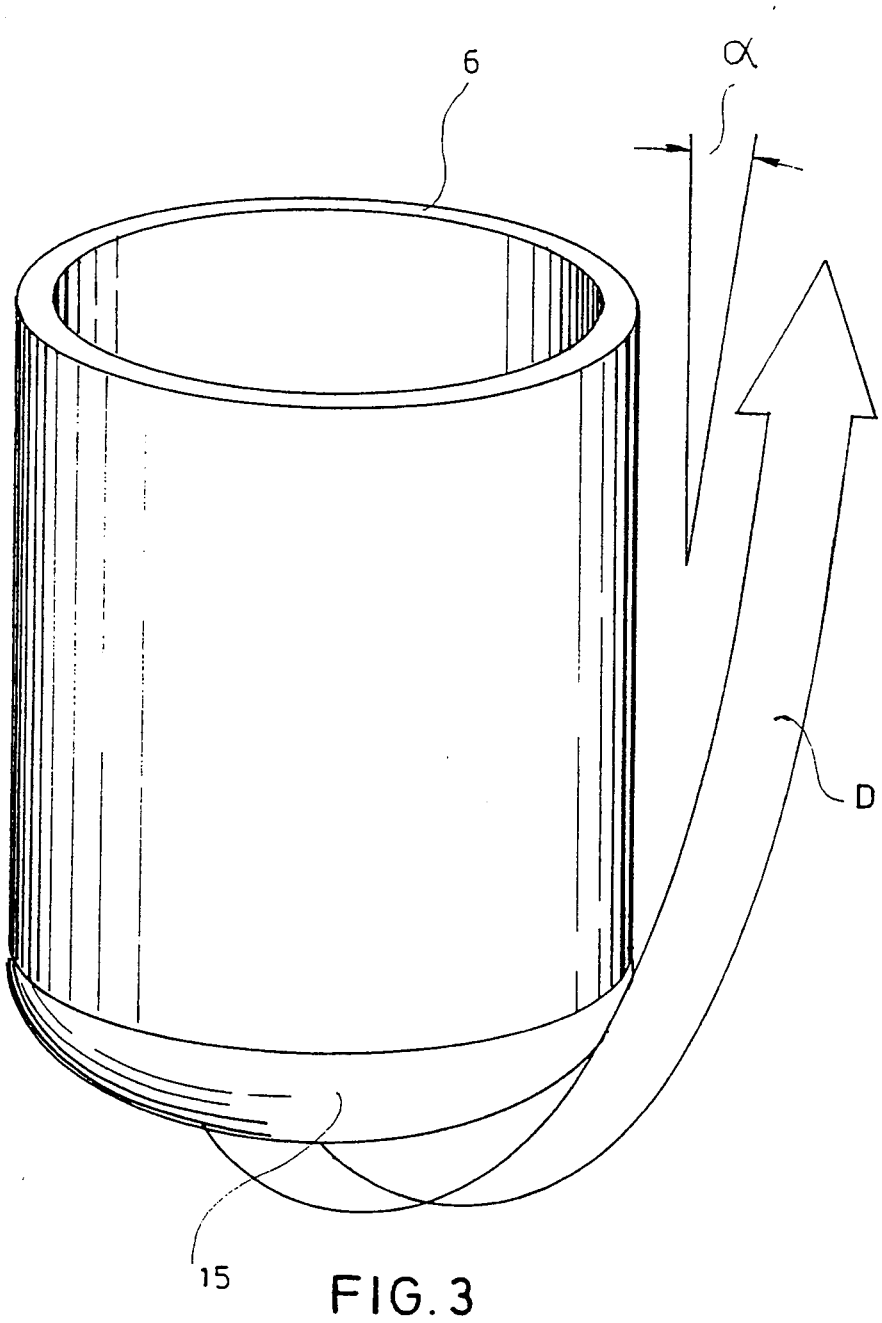
FIG. 3 is a schematic perspective view of the turntable and the protective pot of the two-for-one twisting spindle according to FIGS. 1 and 2.

FIG. 3 shows the path of the jet of compressed air D along the second deflecting surface 15 and the side walls 6 of the protective pot 5 respectively in a perspective view whereby the shown angle $\alpha$ demonstrates the deviation of the thread carried by the jet of compressed air D from the vertical direction. The angle $\alpha$ should be as small as possible.

In the following further embodiments will be described with the aid of FIGS. 4 through 8 in which the width h of the jet of compressed air in the vertical direction is influenced by various means. In the basic representation according to FIG. 2 the width h is delimited by the vertical dimension of the outer opening 12.2 of the thread guiding channel 12. Since, as has been mentioned before, the dimension of the opening may not be reduced indefinitely inserts may be used to reduce the width h. These inserts are mounted onto the lower wall portion of the radial portion 12.1 of the thread guiding channel 12 in the area of the outer opening 12.2. This is represented in FIGS. 4 through 6.

Figure 4:
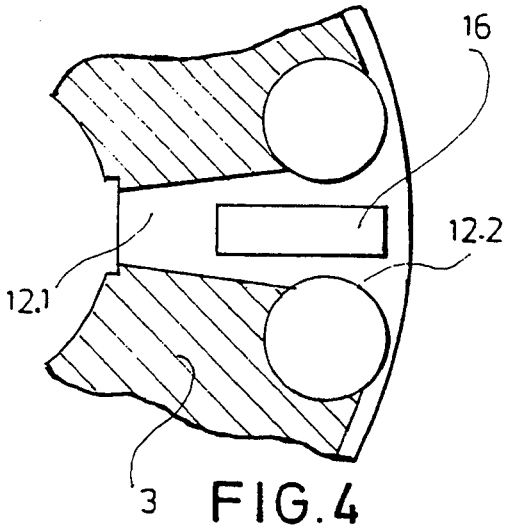
FIGS. 4 and 5 show a plan view of inserts within the thread feeding channel of a second and a third embodiment of the present invention.
Figure 5:
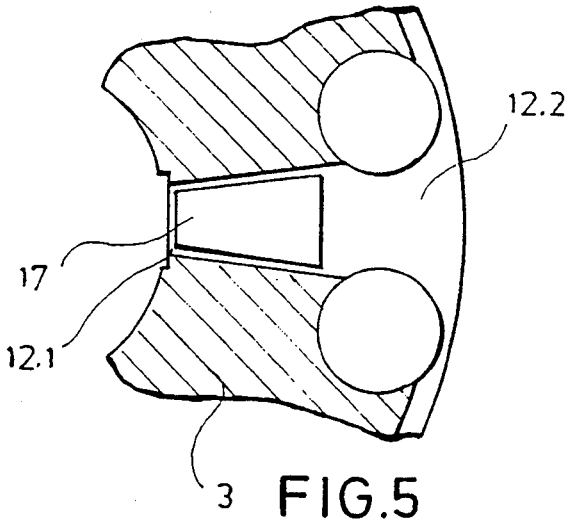

According to FIG. 4 an insert 16 in the form of a wedge is inserted into the thread guiding channel 12 which extends in a horizontal direction over the middle section of the outer opening 12.2. The embodiment according to FIG. 5 shows a wedge insert 17 which is mounted, viewed in the direction of the jet of compressed air, before the outer opening 12.2.

Figure 6:
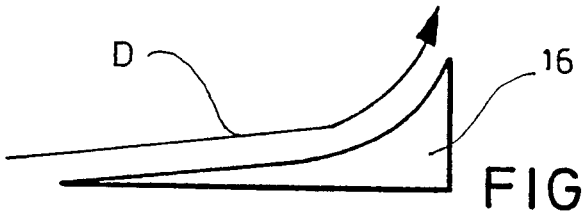
FIG. 6 is an enlarged side view of a detail of the insert according to FIG. 4.
Figure 7:
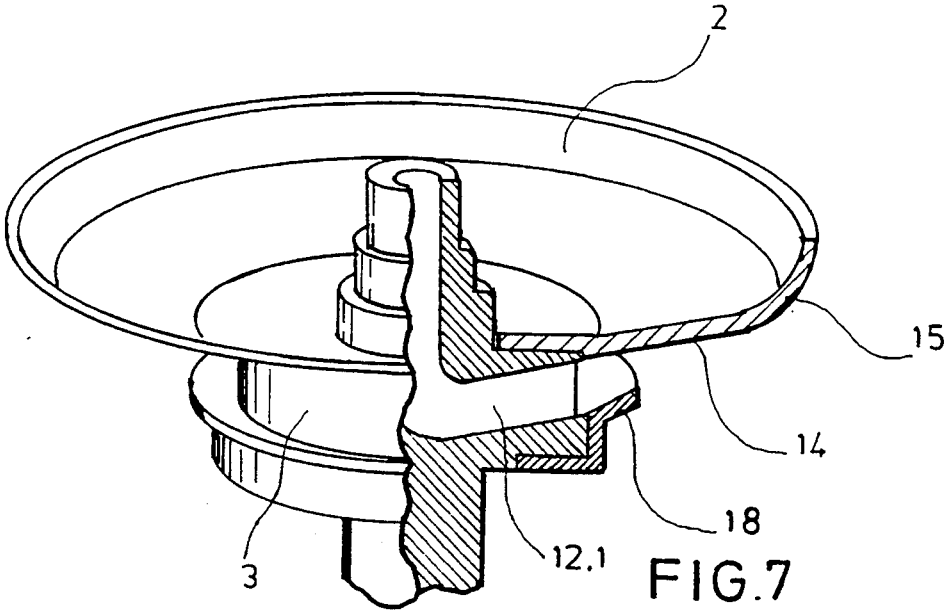
FIG. 7 is a perspective partially sectioned view of the turntable and the thread storage disk of a two-for-one twisting spindle of a fourth embodiment of the present invention.
Figure 8:
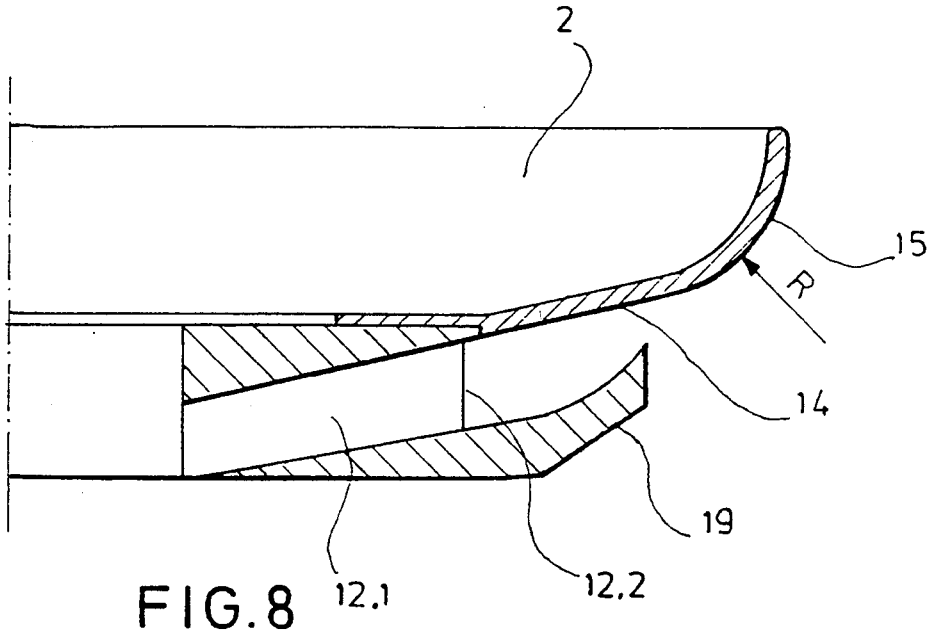
FIG. 8 is a vertical cross-sectional view of a portion of the turntable and the thread storage disk of a two-for-one twisting spindle in the area of the outer end of the thread feeding channel of a fifth embodiment of the invention.

FIG. 6 shows one possible profile of the insert 16 as a cross-sectional vertical cut. The wedge insert exhibits first a linearly ascending profile, viewed in the direction of the jet of compressed air, and then an upwardly curved profile which is essentially concave. Due to the profile of the wedge insert the width h of the jet of compressed air is reduced and a smaller effective value of h is achieved. A further measure for reducing the width h is shown in the embodiment according to FIG. 7. Viewed in the direction of the jet of compressed air, immediately after the outer opening 12.2 of the thread guiding channel 12 a deflector in the form of a ring segment 18 is arranged which is upwardly oriented and, for example, may have an upwardly curved profile which is essentially concave. This may be seen in the embodiment according to FIG. 8 which features a ring segment deflector 19. The ring segment deflector 18 respectively 19 may extend over a portion of the circumference of the thread storage disk 3 or may be embodied as a full ring over the entire circumference of the thread storage disk 3.

Figure 9:
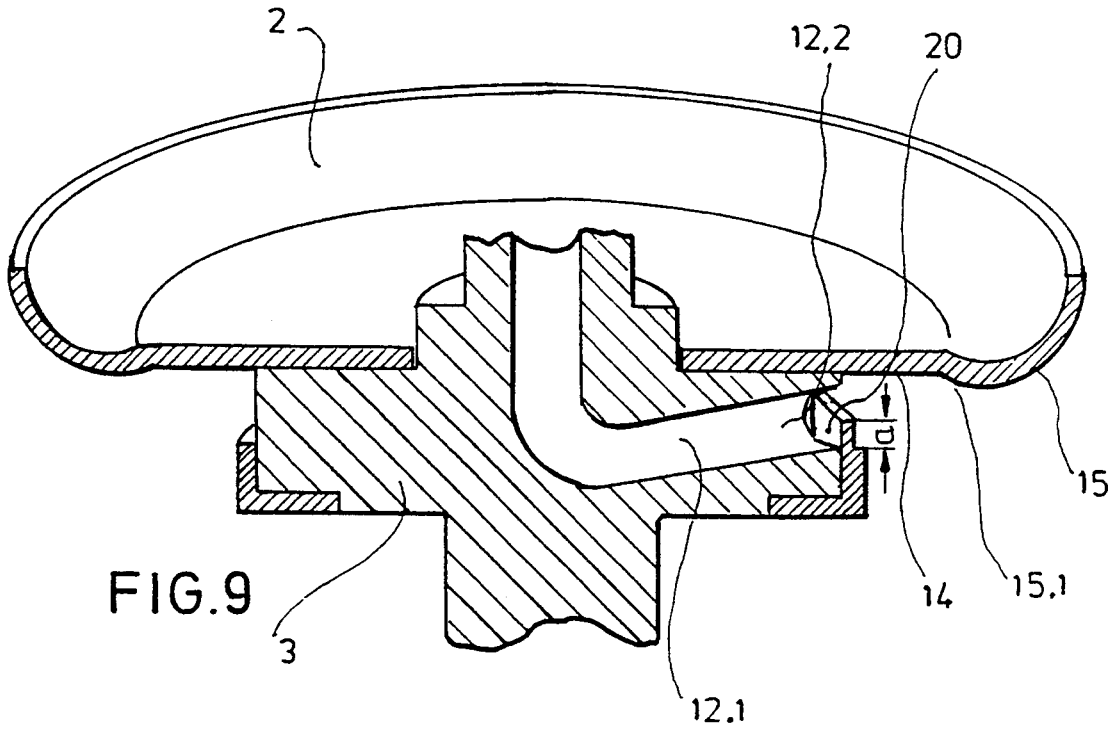
FIG. 9 is a perspective partially sectioned view of the turntable and the thread storage disk of a two-for-one twisting spindle of a sixth embodiment of the invention.

FIG. 9 represents a further measure for achieving an especially effective deflection of the jet of compressed air. In this embodiment a vertically extending deflector plate 20 is arranged at the outer opening 12.2 of the radial portion 12.1 of the thread guiding channel 12 at the outer edge. The deflector plate 20 extends vertically upward over at least a portion of the horizontal width and a portion of the vertical width of the radial portion 12.1 of the thread feeding channel 12. The sharp-edged upper end of the deflector plate 20 effects a great reduction of the upwardly oriented jet of compressed air and thus a reduction of the effective value of the width h exceeding the value a. The free passage of the thread within the thread storage disk 3 groove over the circumference of the thread storage disk is ensured in this embodiment. For the secure functioning of the embodiment the height a of the deflector plate 20 should be from 1 mm to 2 mm.

The present invention is, of course, in no way restricted to the specific disclosure of the specification and drawings, but also encompasses any modifications within the scope of the appended claims.

What we claim is:

1. A two-for-one twisting spindle comprising a compressed air operated threading device with which a thread is fed through a thread feeding channel by a Jet of compressed air, with a first deflecting surface arranged at an underside of a turntable, that is disposed above a thread storage disk, and extending radially outwardly from an opening of a radial portion of said thread feeding channel, said first deflecting surface having a transition into a second deflecting surface which extends in an upward direction and is convex; wherein the improvement comprises:

said jet of compressed air leaving said opening of said thread feeding channel has a width h in a vertical direction and said second deflecting surface has a radius of curvature R, whereby a ratio $R/h \geqq 3$; and wherein a ratio of a first angle $\beta 1$ of upward inclination of an upper wall of said radial portion relative to a horizontal plane to a second angle of upward inclination $\beta 2$ of said first deflecting surface relative to said horizontal plane is $\beta 1 > \beta 2$.

2. A two-for-one twisting spindle according to claim 1, wherein said ratio is $3 \leqq R/h \leqq 5$.

3. A two-for-one twisting spindle according to claim 2, wherein said ratio is at least $R/h = 4$.

4. A two-for-one twisting spindle according to claim 1, wherein said second deflecting surface at an upper end thereof has a vertical tangent.

5. A two-for-one twisting spindle according to claim 1, wherein a third angle $\delta$ is defined between a tangential plane of said second deflecting surface at said transition between said first and said second deflecting surface and said horizontal plane.

6. A two-for-one twisting spindle according to claim 5, wherein said tangential plane is ascending relative to said horizontal plane and said third angle is $0 < \delta < +90°$, with a relation between said second and said third angle being $\delta \leqq \beta 2 < +90°$.

7. A two-for-one twisting spindle according to claim 5, wherein said tangential plane is descending relative to said horizontal plane and said third angle is $-90° < \delta \leqq 0$ and a relation between said second and said third angle is $0 \leqq \beta 2 < +90° + \delta$.

8. A two-for-one twisting spindle according to claim 1, wherein said width h of said jet of compressed air is determined by a height of said opening of said radial portion of said thread feeding channel.

9. A two-for-one twisting spindle according to claim 1, wherein said width h of said jet of compressed air is determined by a deflector plate connected to said opening at a lower edge thereof, said deflector plate extending vertically upward over at least a portion of a horizontal width and a portion of a vertical width of said radial portion of said thread feeding channel and having a sharp-edged upper end.

10. A two-for-one twisting spindle according to claim 9, wherein a vertical height of said deflector plate is from 1 mm to 2 mm.

* * * * *